US006183396B1

(12) United States Patent
Reynier

(10) Patent No.: US 6,183,396 B1
(45) Date of Patent: Feb. 6, 2001

(54) PALM PLATES DESIGNED TO BE ATTACHED TO THE USER'S HANDS IN AN AQUATIC ENVIRONMENT

(76) Inventor: Pascal Reynier, 52 Rue Tour Gayraud, F-34000 Montpellier (FR)

( * ) Notice: Under 35 U.S.C. 154(b), the term of this patent shall be extended for 0 days.

(21) Appl. No.: 09/235,255

(22) Filed: Jan. 22, 1999

(51) Int. Cl.[7] ..... A63B 21/02
(52) U.S. Cl. ..... 482/8; 482/84; 441/56
(58) Field of Search ..... 441/55–64; 482/1–9, 482/83–90, 121, 124; 434/247, 258

(56) References Cited

U.S. PATENT DOCUMENTS 4,763,284 * 8/1988 Carlin ..... 482/84
5,857,947 * 1/1999 Dicker et al. ..... 482/124

* cited by examiner

*Primary Examiner*—Glenn E. Richman
(74) *Attorney, Agent, or Firm*—Harrison & Egbert

(57) ABSTRACT

A palm plate designed to be attached to the hand of a user. The palm plate has a surface of a fitted form upon which the hand rests. The plate is equipped with an attached mechanism having a sensor. The sensor can transmit a signal to a microprocessor capable of calculating a certain number of parameters which are displayed on a read-out screen. The microprocessor, its electronic system and the screen are carried by the plate.

8 Claims, 4 Drawing Sheets

PALM PLATES DESIGNED TO BE ATTACHED TO THE USER'S HANDS IN AN AQUATIC ENVIRONMENT

TECHNICAL FIELD

The object of the invention presented here is palm plates for aquatic activities.

BACKGROUND ART

Plates of this type do not have a not particularly rigid form, and generally have a surface area greater than that of the hand, are used for aquatic activities. These plates are attached to the user's hands by elastic straps. These plates or pallets make it possible for the swimmer to have better support in water.

For this purpose, different manufacturers have attempted to optimize the shapes and dimensions of the plates. These prior art palm plates do not make it possible to have an analysis of different parameters such as the better motive path for the arms or the number of cycles made by the arms.

To carry out this analysis it is necessary to turn to an assistant who will make the count within a given time measured with a stopwatch. As far as the measure of the force exerted by the palm plates in water and that of the muscular work performed is concerned, the user can only trust his own estimations, using current mechanisms.

SUMMARY OF THE INVENTION

The invention presented here provides a solution to these problems by creating palm plates for users that makes it possible to check different parameters of aquatic operation, as follows:

(1) to know the force of the palm plates and to define the best motive path for the arms. This makes it possible for the user to adapt his movements to his morphology while improving his performances;

(2) to know the number of arm cycles made during a session, quantify the forces produced and measure their progression.

The invention quantifies based on measurements made, all aspects of aquatic movements. These aspects includes the average supporting force and the number of arm cycles over distances to be chosen by the user; the time intervals; the total muscular work; the number of calories burned, etc.

For this purpose, at least one of the plates is equipped with at least one sensor having a signal that is transmitted to a programmed microprocessor capable of analyzing and calculating a certain number of predetermined parameters that are saved in memory and can appear on a readout screen. The microprocessor is electronics and the screen are carried by the plate.

According to another characteristic of the invention, the sensor used is a pressure sensor.

According to another characteristic of the invention, the wall of the plate has a boss on which the palm of the hand is supported.

According to yet another characteristic, the boss holds the sensor.

BRIEF DESCRIPTION OF THE DRAWINGS

Other advantages and characteristics of the invention appear in reading the following description of the embodiment forms of the invention given as non-restrictive examples and shown by the attached drawings, in which.

DETAILED DESCRIPTION OF THE INVENTION

As shown in the attached drawings, the palm plate according to the invention is made of a plate 1 in a shape fitted to that of the hand.

The wall 1 is preferably rigid and its shape can be arbitrary. The area of the plate area is preferably greater than that of the hand.

The plate 1 can be made of any material such as wood, metal, synthetic materials, resins, etc.

Figure 1:
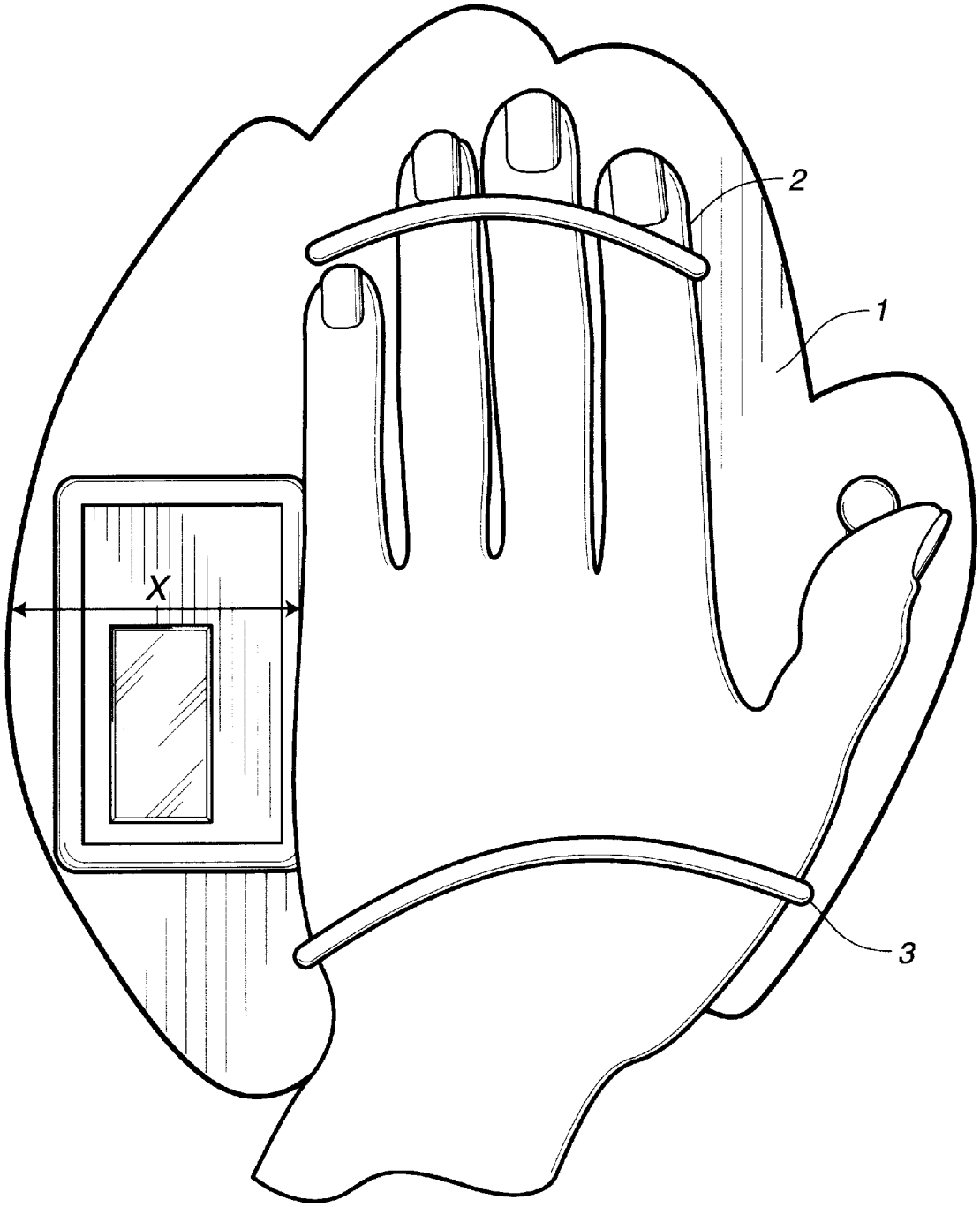
FIG. 1 is a top view of the palm plate in position on the hand.

Preferably, the height or the length of the plate is greater than the length of the hand taken from the point of origin of the wrist to the end of the fingers and its width is greater than the width of the hand by a value shown by "x" in FIG. 1.

The total width of the plate 1 is such that it supports the fingers and such that the thumb can be freely positioned on the plate 1.

The plate 1 is equipped with mechanisms for attaching to the hand that are preferably made up of an upper flexible and/or elastic strap 2 at the fingers and in proximity to their ends and a flexible and/or elastic strap 3 at the back of the hand. The straps are attached to the surface of the plate in any known manner. Each set is made up of two plates, one for each hand. Preferably, the manufacture is done by selecting a fitted form making possible equal adaptation to the left hand or the right hand.

Figure 2:
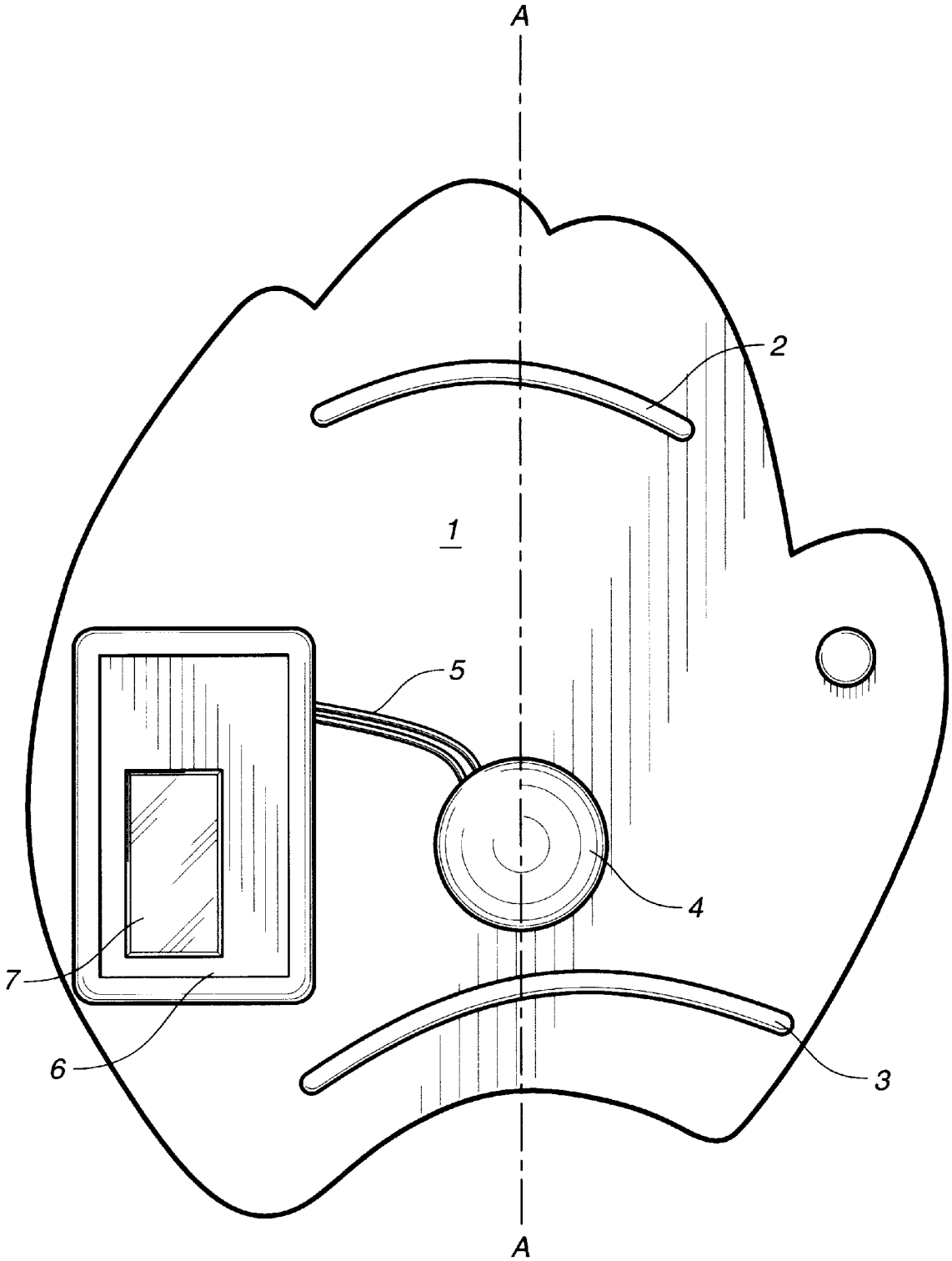
FIG. 2 shows the palm plate without the hand.

According to the invention, at least one of the plates is equipped with at least one sensor 4 shown in FIG. 2. The sensor is positioned so that it can be placed on the plate preferably at the palm of the hand. The sensor 4 is connected by a wire connection 5 to a microprocessor having an adapted electronic system housed in an airtight housing 6 attached to the plate. The housing 6 is preferably attached to the plate over its section x that extends beyond the side of the hand opposite the thumb.

The housing 6 to the side of the hand is equipped with a screen 7 for display of the parameters calculated by the microprocessor from the data picked up by the sensor. The microprocessor is programmed for this purpose in a known manner. The electronics assisting the microprocessor include a memory making it possible to record different parameters, to make calculations and to produce them upon demand. These parameters can be the supporting force and/or the number of arm cycles and/or the time, the forces produced and/or the calories spent and/or the water temperature and/or a pulse meter. A clock is attached to calculate the time.

Advantageously, one or more start/stop control buttons and/or selection buttons for any of the determined parameters is or are arranged either on the housing, or on the housing, or at the area of the mobile thumb, in position on the plate. A single system for control by pressure can be mounted, at the area of the thumb with discrimination of the functions of start/stop and of the parameters to be programmed and/or to be recreated for display on the screen. In this case, the discrimination can be made by the number of pulses given by the thumb.

Figure 3:
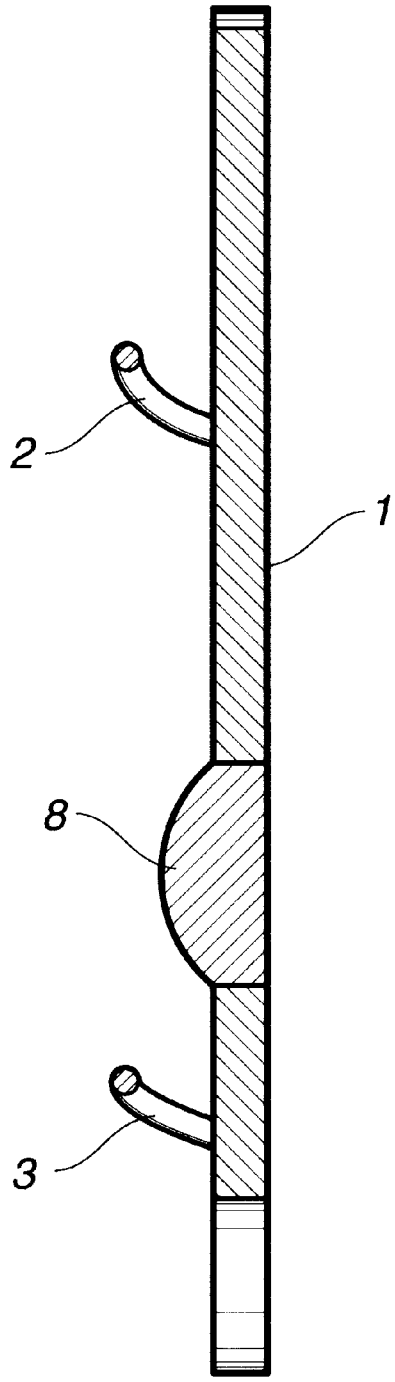
FIG. 3 is a sectional view of the plate according to the reference A—A of FIG. 2.

According to a preferred embodiment form, the sensor 4 is a pressure sensor of the type that is well known. As shown in FIG. 3, the plate 1 can have a boss 8 on which is supported the palm of the hand. This boss conforms to the pit of the palm of the hand, i.e. the front side of the hand.

The boss 8 can be formed directly from manufacturing by molding, thermoforming or embossing. The boss 8 can also be a full or hollow piece that is added and attached to the wall.

Figure 4:
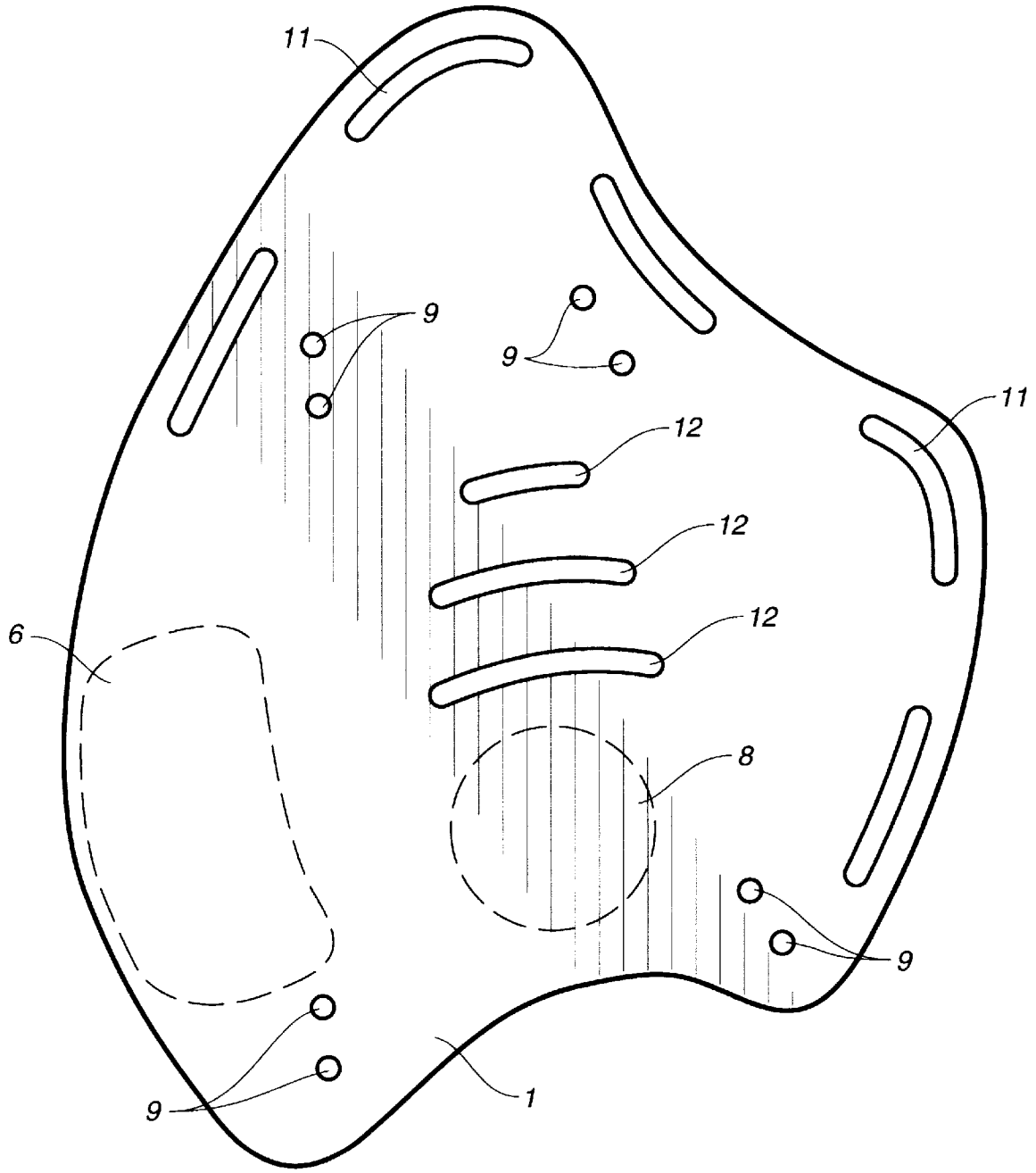
FIG. 4 is a plan view of another model of the plate.

FIG. 4 shows a particular embodiment of a plate according to the invention made up of a plate 1 on which the placement of the microprocessor 6 and its electronic system, which are contained in an airtight housing, and the placement of the boss 8, are shown in dashed lines. The plate is equipped with holes 9 for passing through elastic straps.

According to the preferred embodiment form, the plate 1 is equipped with apertures 11 and 12 going through it which allow water to pass through. This allows the user to have the sensation of water passing over his hand. Advantageously, apertures 11 are placed adjacent the periphery of the plate 1 and apertures 12 are transversal, preferably parallel and are placed in the middle.

What is claimed is:

1. A device for attachment to a hand of a swimmer comprising:

a plate having a surface suitable for receipt of the hand thereon;

attachment means affixed to said plate, said attachment means for securing the hand against said surface;

at least one pressure sensor affixed to said plate; and a microprocessor means electrically connected to said sensor, said microprocessor means for receiving a signal from said pressure sensor, said microprocessor means for calculating a plurality of parameters from said signal, said microprocessor means having an electronic system and a read-out screen directly affixed to said plate, said microprocessor means for quantifying aspects of aquatic movements based on said signal from said pressure sensor and for displaying the quantified aspects on said read-out screen.

2. The device of claim 1, said surface having a boss thereon suitable for supporting a palm of the hand.

3. The device of claim 2, said sensor received by said boss.

4. The device of claim 1, said read-out screen being affixed to said plate at a side of said attachment means.

5. The device of claim 1, said plate having apertures formed therethrough so as to allow a passage of water therethrough.

6. The device of claim 1, said plurality of parameters comprising a supporting force, a number of arm cycles, a swimming force produced, a time, and a number of calories burned.

7. The device of claim 1, further comprising:

control button means arranged on said plate and electronically connected to said microprocessor means, said control button means for selecting one of said plurality of parameters for display on said read-out screen.

8. The device of claim 1, said electronic system housed in an airtight housing attached to said plate, said read-out screen affixed to said airtight housing.

* * * * *